US007479597B1

(12) United States Patent
Cases et al.

(10) Patent No.: US 7,479,597 B1
(45) Date of Patent: Jan. 20, 2009

(54) CONDUCTOR CABLE HAVING A HIGH SURFACE AREA

(75) Inventors: Moises Cases, Austin, TX (US); Daniel N. de Araujo, Cedar Park, TX (US); Bhyrav Murthy Mutnury, Austin, TX (US); Nam Huu Pham, Round Rock, TX (US); Bruce James Wilkie, Georgetown, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/946,165

(22) Filed: Nov. 28, 2007

(51) Int. Cl.
*H01B 7/00* (2006.01)

(52) U.S. Cl. ..... 174/36; 174/115; 174/129 R; 174/133 R

(58) Field of Classification Search ..... 174/36, 174/110 R, 113 R, 115, 129 R, 133 R
See application file for complete search history.

(56) References Cited

U.S. PATENT DOCUMENTS

| | | | | | |
|---|---|---|---|---|---|
| 290,769 | A * | 12/1883 | Hunter et al. | ..... | 174/133 R |
| 543,960 | A * | 8/1895 | Gray | ..... | 174/133 R |
| 796,100 | A * | 8/1905 | Wilson | ..... | 178/45 |
| 2,149,772 | A * | 3/1939 | Hunter et al. | ..... | 174/26 R |
| 4,101,731 | A * | 7/1978 | Marancik | ..... | 174/125.1 |
| 4,463,219 | A * | 7/1984 | Sato | ..... | 174/127 |
| 5,696,352 | A * | 12/1997 | Kourimsky | ..... | 174/126.3 |
| 5,990,419 | A * | 11/1999 | Bogese, II | ..... | 174/120 R |
| 6,967,289 | B2 * | 11/2005 | Goto | ..... | 174/129 R |
| 7,214,880 | B2 * | 5/2007 | Wiekhorst et al. | ..... | 174/80 |
| 2007/0277996 | A1 * | 12/2007 | Caveney et al. | ..... | 174/129 R |

FOREIGN PATENT DOCUMENTS

| | | | |
|---|---|---|---|
| DE | 19519582 | | 12/1996 |
| DE | 199220199 | A * | 5/1999 |
| JP | 2002298662 | | 10/2002 |

* cited by examiner

*Primary Examiner*—William H Mayo, III
(74) *Attorney, Agent, or Firm*—Cynthia Byrd; Jeffrey L. Streets

(57) ABSTRACT

A cable having an electrically conducting wire with a cross sectional shape defined by a simple closed curve having from three to eight concave portions separated by an equal number of convex portions. The simple closed curve has no point where the radius of curvature is less than one-sixth (⅙) of an overall radius of the wire and no point where adjacent curves or lines intersect at an angle. The alternating concave and convex portions of the cable's cross-sectional shape may have substantially the same curvature. The cross-sectional shape of the cable avoids sharp angles and fight curves.

12 Claims, 6 Drawing Sheets

CONDUCTOR CABLE HAVING A HIGH SURFACE AREA

BACKGROUND OF THE INVENTION

1. Field of the Invention

The present invention relates to electronically conducting cable or wire having a high surface area to reduce attenuation of high frequency signal transmissions due to the skin effect.

2. Description of the Related Art

The main properties of a cable are its inductance, capacitance, effective shunt conductance, and series resistance per unit length. Taken together, these properties include the signal transmission and loss properties when a length of cable is employed as part of a system. As signals are being transmitted through cables at higher and higher frequencies, loss or attenuation is becoming a big problem. The two main reasons for attenuation in cables are dielectric loss and skin effect. However, the effect of dielectric loss in cables is minimum and skin effect dominates the loss and attenuation in cables.

The skin effect is the tendency of an alternating electronic current (AC) to distribute itself within a conductor so that the current density near the surface of the conductor is greater than that at its core. That is, the electric current tends to flow at the "skin" of the conductor. The skin effect causes the effective resistance of the conductor to increase with increasing frequency of the current. In fact, the skin depth is inversely proportional to the operating frequency.

FIG. 1 is a cross-sectional view of a typical round conductor cable 10. At frequencies below about 100 MHz, the electronic current flows throughout the cable with a fairly uniform distribution. In other words, there is no part of the wire cross-section that carries substantially more current than any other part of the wire cross-section. However, as the frequency increase above about 100 MHz, the flow of current begins to concentrate near the surface or "skin" of the wire. At much higher frequencies, the entire current will flow in a very narrow band or skin 12 on the conductor, such that only a small percentage of the total cross-sectional area of the cable 10 is effective for conducting high frequency current One approach that attempts to deal with the skin effect is increasing the diameter of the conductor cable to provide a larger surface area over which the current can flow. However, this approach produces very large, bulky cables and makes inefficient use of the metal conductor. Another approach plates the conductor cable with gold or silver to modify the frequency response within the cable and lower the resistivity of the cable at higher frequencies.

Yet another approach has been to cut or shape a conductor cable to increase the amount of surface area. However, these types of increased surface area have still not led to the development of a conductor cable having the desired low resistivity at high frequencies. Therefore, there remains a need for a conductor cable that provides low resistivity under high frequency current.

SUMMARY OF THE INVENTION

One embodiment of the invention provides a cable comprising an electronically conducting wire with a cross-sectional shape defined by a simple closed curve having from 3 to 8 concave portions separated by an equal number of convex portions, wherein the simple closed curve has no point where the radius of curvature is less than one-sixth (⅙) of an overall radius of the wire and no point where adjacent curves or lines intersect at an angle. In a further embodiment, the alternating concave and convex portions of the cable's cross-sectional shape have substantially the same curvature. Other embodiments may provide the surface area of the wire has a substantially continuous charge distribution under a high frequency electronic signal, such as a signal having a frequency greater than 100 MHz.

Other embodiments, aspects, and advantages of the invention will be apparent from the following description and the appended claims.

DETAILED DESCRIPTION OF PREFERRED EMBODIMENTS

Figure 1:
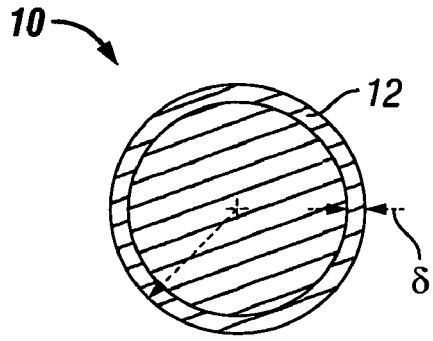
FIG. 1 (Prior Art)
FIG. 1 is a cross-sectional view of a prior art conductor cable that is round.
Figure 2:
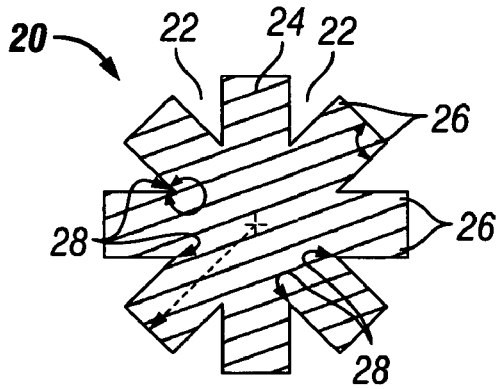
FIG. 2 (Prior Art)
FIG. 2 is a cross-sectional view of a prior art conductor cable that is notched.

FIG. 2 is a cross-sectional view of a prior art conductor cable 20 that includes a number of spaced apart notches 22 forming a number of protruding square ribs 24. The perimeter of the cable 20 provides much more surface area per unit length of cable than the round cable 10 of FIG. 1. Yet according to the present invention, it has been discovered that at high frequencies, charge distribution is absent in regions with sharp angles. Cable 20 has a large number of angles over the perimeter of its cross-section, including sixteen internal right angles 26 and eight internal obtuse angles 28.

Figure 3:
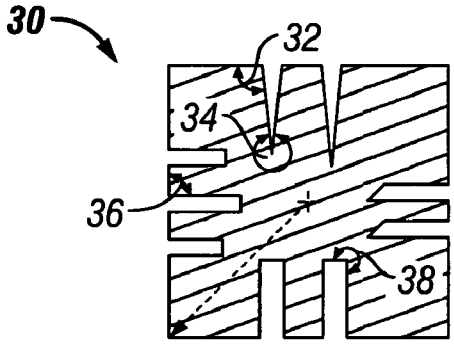
FIG. 3 (Prior Art)
FIG. 3 is a cross-sectional view of a prior art conductor cable in the shape of a notched square.

FIG. 3 is a cross-sectional view of a prior art conductor cable 30 in the shape of a notched square. The nine notches are provided in various shapes and depths, but each notch introduces one or more sharp angles 34, 36, 38 into the perimeter of the cross-section.

Figure 4:
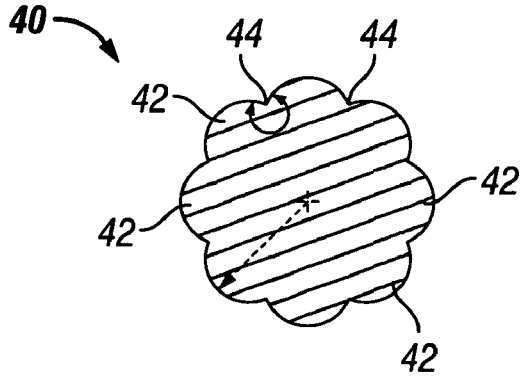
FIG. 4 (Prior Art)
FIG. 4 is a cross-sectional view of a prior art conductor cable having a plurality of convex portions.

FIG. 4 is a cross-sectional view of a prior art conductor cable 40 having a plurality of convex portions 42. However, the adjacent portions 42 meet at an angle 44 to disturb or prevent a uniform distribution of current flow along the perimeter.

Figure 5:
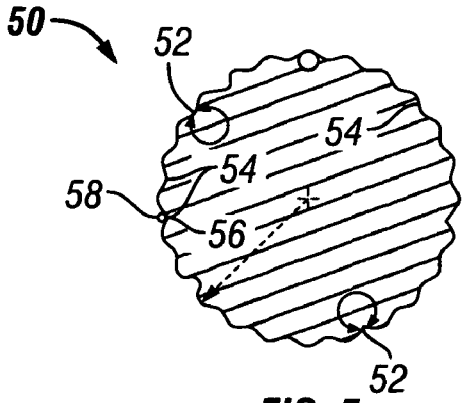
FIG. 5 (Prior Art)
FIG. 5 is a cross-sectional view of a prior art conductor cable having small and somewhat irregular waves.

FIG. 5 is a cross-sectional view of a prior art conductor cable 50 having small and somewhat irregular waves over the perimeter. The waves appear to include some sharp angles 52 as well as some curves 54 having a radius of curvature considerably less than $1/10^{th}$ or $1/20^{th}$ of the radius of the overall wire. Such angles and tight curves do not provide good current flow along the surface. The radius of curvature at point 56 on the perimeter may be represented by a circle 58 having the same radius and contacting the perimeter at point 56.

Figure 6:
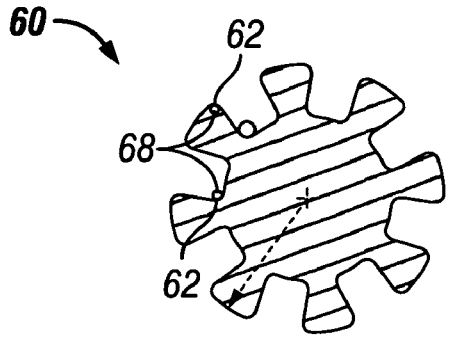
FIG. 6 (Prior Art)
FIG. 6 is a cross-sectional view of a prior art conductor cable having a complex "gear-like" shape.

FIG. 6 is a cross-sectional view of a prior art conductor cable 60 having a complex "gear-like" shape. Although the perimeter of the cross-section does not appear to include any sharp angles, many of the curves 62 have a radius of curvature (represented by circle 68) that is less than $1/10^{th}$ the radius of the overall wire.

Figure 7:
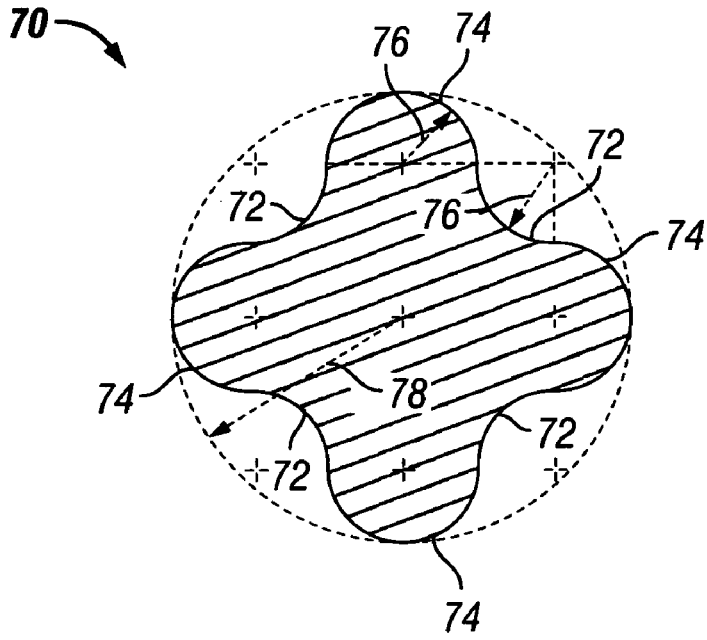
FIG. 7 is a cross-sectional view of a first embodiment of a conductor cable of the present invention.

FIG. 7 is a cross-sectional view of a first embodiment of a conductor cable 70 of the present invention. The cross-section of the cable 70 has no sharp angles and no tight curves. The perimeter of the cable 70 has four concave portions 72 and four convex portions 74, wherein each portion has the same radius of curvature (shown by the radial arrows 76). The arc of the concave portions 72 extends about 90 degrees and the arc of the convex portions 74 extends about 180 degrees (delimited by the dashed lines). The cable 70 provides greater surface area per unit length of cable than a round cable having the same overall radius 78 and provides a substantially uniform distribution of current over the surface even with high frequency signals. These results are achieved with a cable having an effective cable diameter and volume that is very similar to that of a round cable. The greater amount of surface area decreases the cable loss resulting from skin effect and improves the performance of the cable for high-frequency signals.

The cross-sectional shape of the cable is a result of the inventors' discovery that not all surface area of a cable is effective in lowering resistance per unit length for cables carrying high-speed signals. Specifically, surface area near a sharp angle or curve with an extremely small radius of curvature will not carry a proportionate amount of a high speed current signal flowing in a skin near the surface of the cable. Rather, sharp edges disturb or prevent a uniform distribution of current flow along the entire surface area and result in current crowding phenomenon in areas without sharp angles. Therefore, sharp angles formed in the cross-sectional shape of a cable to reduce attenuation by increasing the total surface area, may actually cause an increase in attenuation, because the effective surface area for current distribution in reality is reduced. Accordingly, rather than merely maximizing cable surface area, the cables of the present invention produce a more-uniform distribution of current over the entire surface area by having a cross-section with no sharp angles and no small radius of curvature. The ratio of the radius of curvature 76 to the overall radius 78 of the cable is about 1:3.

Figure 8:
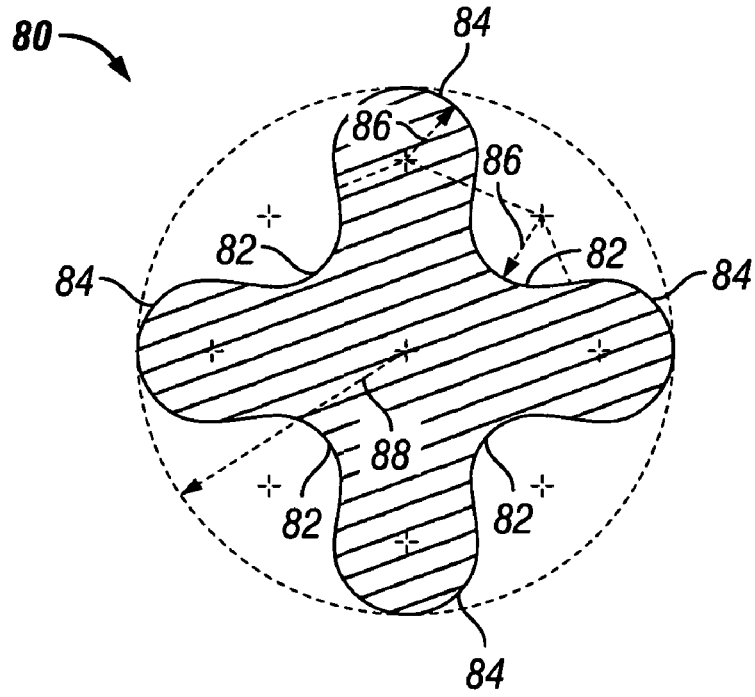
FIG. 8 is a cross-sectional view of a second embodiment of a conductor cable of the present invention.

FIG. 8 is a cross-sectional view of a second embodiment of a conductor cable 80 of the present invention. Like conductor cable 70, the cable 80 has no sharp angles, no tight curves, four concave portions 82 and four convex portions 84, wherein each portion has the same radius of curvature (shown by the radial arrows 86). However, the arc of the concave portions 82 extends about 230 degrees and the arc of the convex portions 84 extends about 140 degrees (delimited by the dashed lines). The cable 80 provides greater surface area per unit length of cable than even cable 70, while still providing a substantially uniform distribution of current over the surface even with high frequency signals. The ratio of the radius of curvature 86 to the overall radius 88 of the cable is about 1:4.

Figure 9:
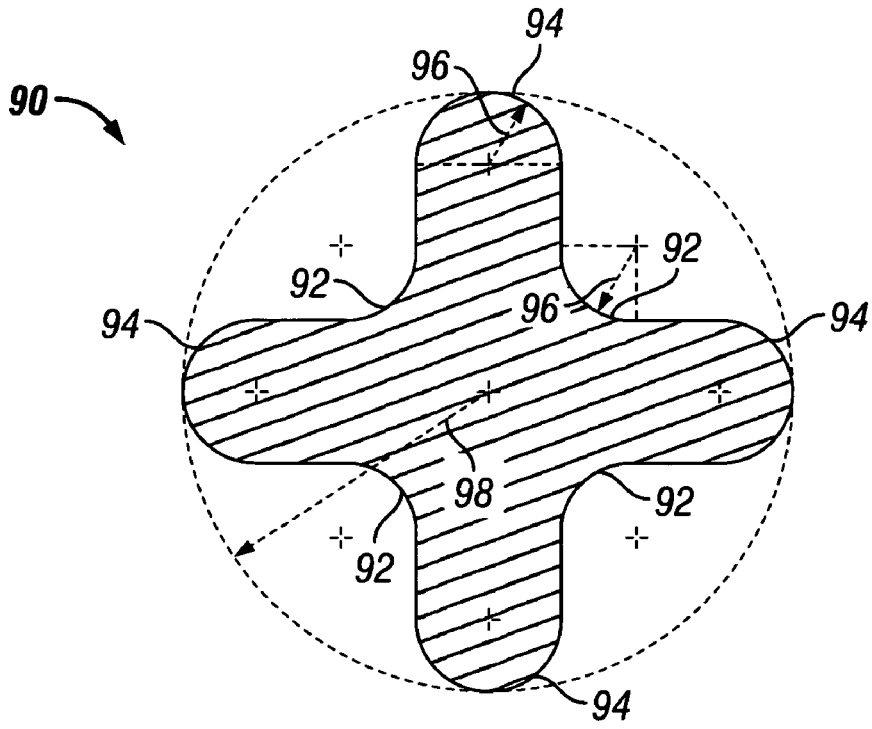
FIG. 9 is a cross-sectional view of a third embodiment of a conductor cable of the present invention.

FIG. 9 is a cross-sectional view of a third embodiment of a conductor cable 90 of the present invention. The cable 90 has no sharp angles, no tight curves, four concave portions 92 and four convex portions 94, wherein each portion has the same radius of curvature (shown by the radial arrows 96). Like cable 70, the arc of the concave portions 92 extends about 180 degrees and the arc of the convex portions 94 extends about 90 degrees (delimited by the dashed lines). However, the concave and convex portions are separated by linear or nearly linear regions 95. The cable 90 provides greater surface area per unit length of cable than even cable 70, while still providing a substantially uniform distribution of current over the surface even with high frequency signals. The ratio of the radius of curvature 96 to the overall radius 98 of the cable is about 1:4.

Figure 10:
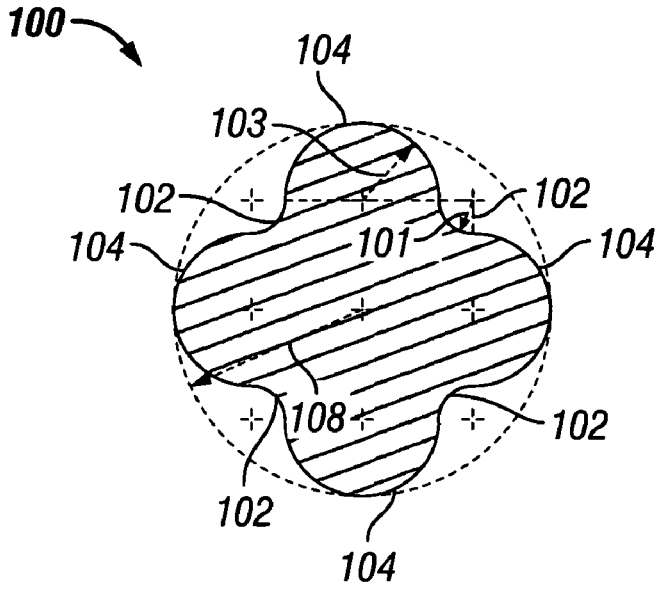
FIG. 10 is a cross-sectional view of a fourth embodiment of a conductor cable of the present invention.

FIG. 10 is a cross-sectional view of a fourth embodiment of a conductor cable 100 of the present invention. The cable 100 has no sharp angles, no tight curves, four concave portions 102 and four convex portions 104. However, the radius of curvature 101 of the concave portions 102 is smaller than the radius of curvature 103 of the convex portions 104. Like cable 70, the arc of the concave portions 102 extends about 90 degrees and the arc of the convex portions 104 extends about 180 degrees (delimited by the dashed lines). The cable 100 provides greater surface area per unit length of cable than a round cable, while still providing a substantially uniform distribution of current over the surface even with high frequency signals. The ratio of the smallest radius of curvature of the cable (radius of curvature 101) to the overall radius 108 of the cable is about 1:5.

Figure 11:
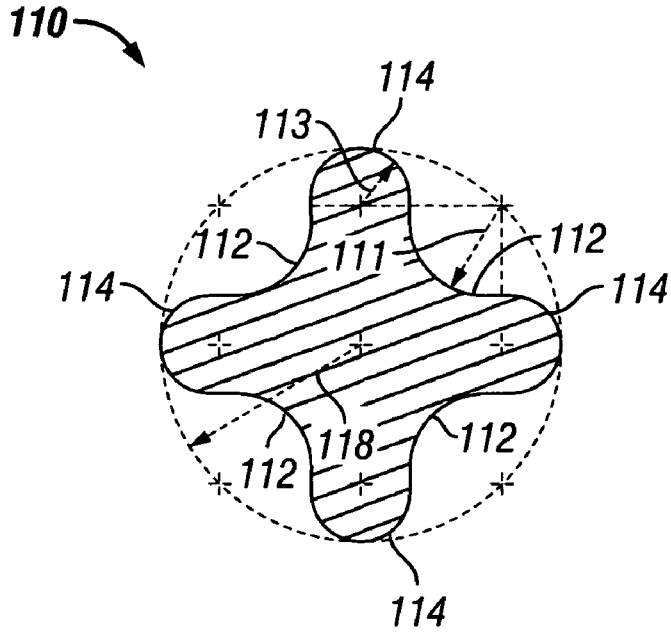
FIG. 11 is a cross-sectional view of a fifth embodiment of a conductor cable of the present invention.

FIG. 11 is a cross-sectional view of a fifth embodiment of a conductor cable 110 of the present invention. The cable 110 has no sharp angles, no tight curves, four concave portions 112 and four convex portions 114. However, the radius of curvature 111 of the concave portions 112 is greater than the radius of curvature 113 of the convex portions 114. Like cable 70, the arc of the concave portions 112 extends about 90 degrees and the arc of the convex portions 114 extends about 180 degrees (delimited by the dashed lines). The cable 100 provides greater surface area per unit length of cable than a round cable, while still providing a substantially uniform distribution of current over the surface even with high frequency signals. The ratio of the smallest radius of curvature of the cable (radius of curvature 113) to the overall radius 118 of the cable is about 1:4.

Figure 12:
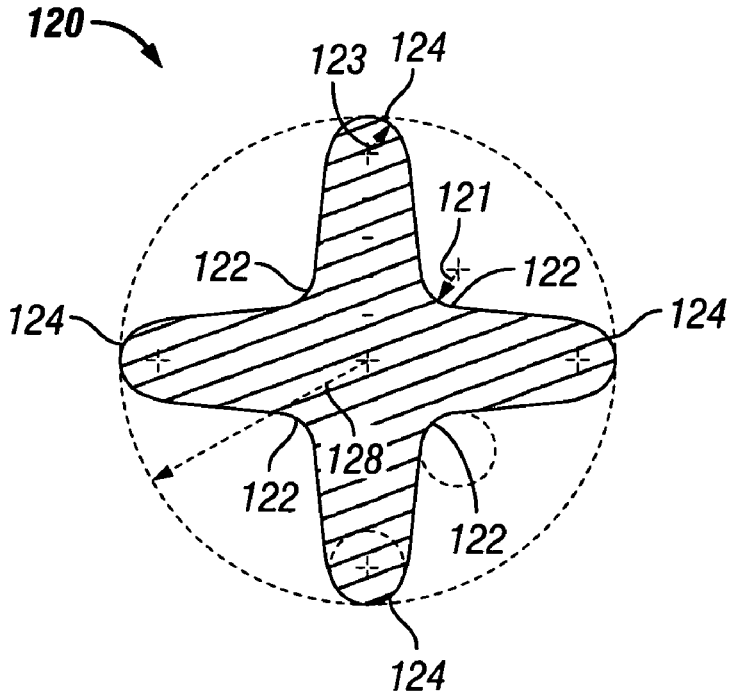
FIG. 12 is a cross-sectional view of a sixth embodiment of a conductor cable of the present invention.

FIG. 12 is a cross-sectional view of a sixth embodiment of a conductor cable 120 of the present invention. The cable 120 has no sharp angles, no tight curves, four concave portions 122 and four convex portions 124. However, the radius of curvature of the concave and convex portions is not constant. Rather, the radius of curvature may be considered as changing over the perimeter. Still, in order to avoid tight curves, the tips of convex portions 124 and the base of the concave portions 122, where the radius of curvature is generally the smallest, may each have a constant radius of curvature. The convex and concave portions may also have an elliptical profile, so long as the radius of curvature is still sufficient to support a uniform distribution of current flow. The ratio of the smallest radius of curvature of the cable (for example, radius of curvature 123) to the overall radius 128 of the cable is about 1:6.

Figure 13:
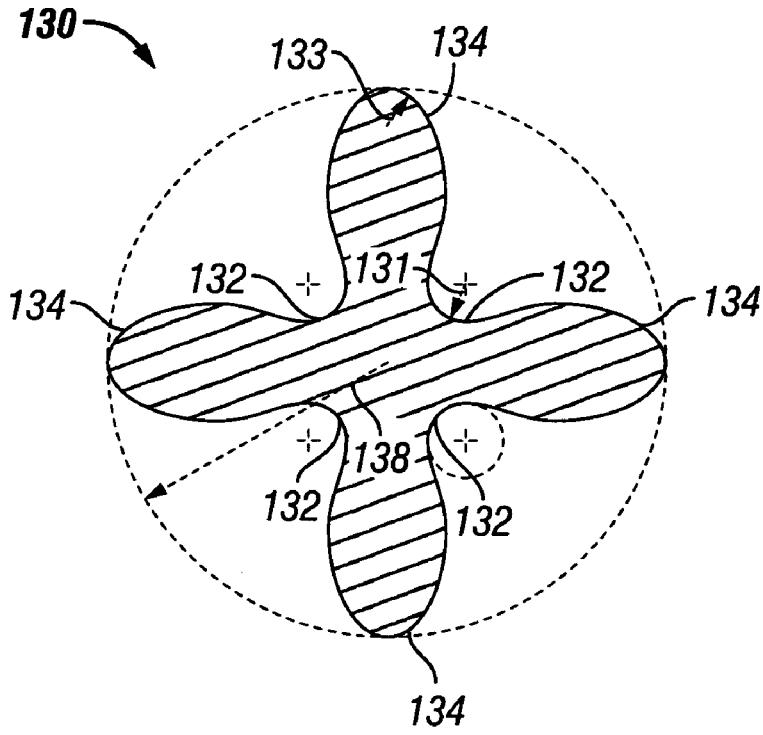
FIG. 13 is a cross-sectional view of a seventh embodiment of a conductor cable of the present invention.

FIG. 13 is a cross-sectional view of a seventh embodiment of a conductor cable 130 of the present invention. The cable 130 has no sharp angles, no tight curves, four concave portions 132 and four convex portions 134. The radius of curvature of the concave and convex portions is not constant, and may be considered as changing over portions of the perimeter. Still, in order to avoid any point of the perimeter having a small radius of curvature, the convex portions 134 and the concave portions 132 are boldly rounded. The ratio of the smallest radius of curvature of the cable (for example, radius of curvature 133) to the overall radius 138 of the cable is about 1:6. It is believed that the surface area per unit length of cable 130 will be greater than that of cable 120 for any given overall radius and minimum radius of curvature, because of the bold, sweeping curves.

Figure 14:
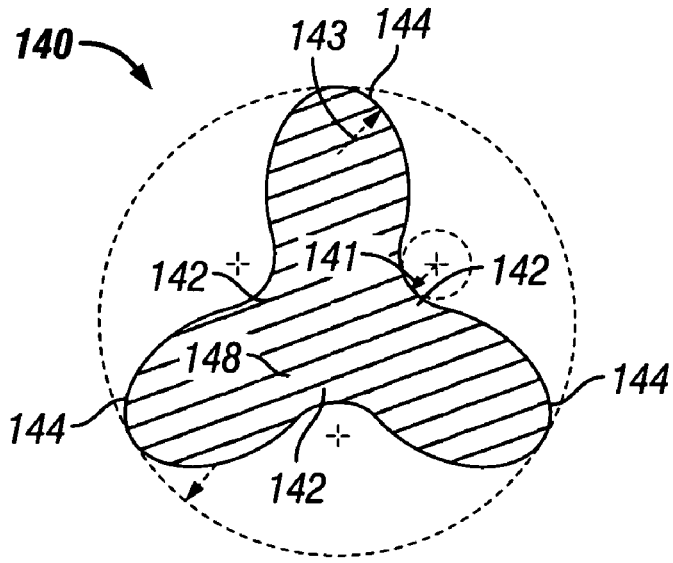
FIG. 14 is a cross-sectional view of an eighth embodiment of a conductor cable of the present invention.

FIG. 14 is a cross-sectional view of an eighth embodiment of a conductor cable 140 of the present invention. The cable 140 has no sharp angles, no tight curves, three concave portions 142 and three convex portions 144. The radius of curvature of the concave and convex portions is not constant, and may be considered as changing over portions of the perimeter. The convex portions 144 and the concave portions 142 are boldly rounded so that the ratio of the smallest radius of curvature of the cable (for example, radius of curvature 143) to the overall radius 148 of the cable is about 1:4. According to the present invention, there may be from 3 to about 8 convex portions with an equal number of concave portions there between.

Figure 15:
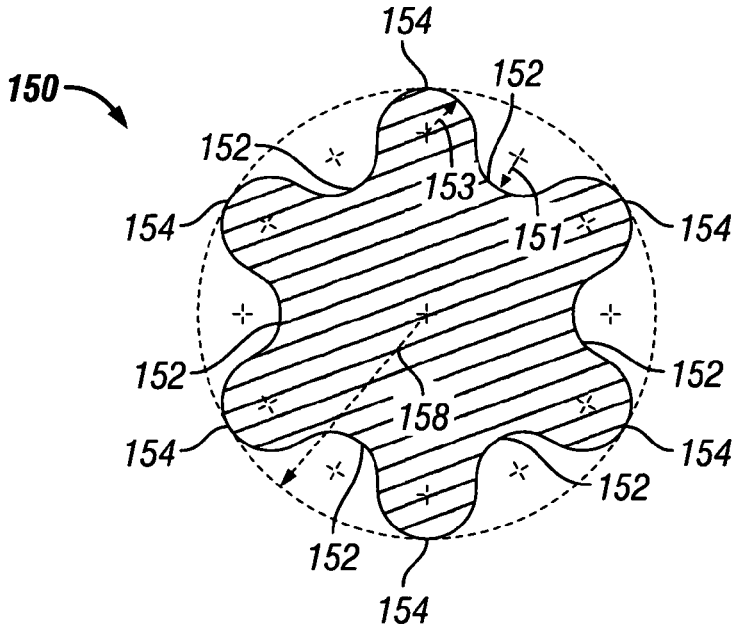
FIG. 15 is a cross-sectional view of a ninth embodiment of a conductor cable of the present invention.

FIG. 15 is a cross-sectional view of a ninth embodiment of a conductor cable 150 of the present invention. The cable 150 has no sharp angles, no tight curves, six concave portions 152 and six convex portions 154, wherein the radius of curvature of each of the portions is the same. The ratio of the smallest radius of curvature of the cable (either radius of curvature 153 or 151) to the overall radius 158 of the cable is about 1:5.

In FIGS. 7 through 15, various embodiments of the invention have been shown. These embodiments each provide greater surface area per unit length than round cables, while avoiding sharp angles or tight curves that have been found by the inventors to carry less than a proportionate amount of a high speed current signal flowing in a skin near the surface of the cable. Accordingly, a cable of the invention should have a cross-sectional shape defined by a simple closed curve having no point where the radius of curvature is less than one-sixth (⅙) of an overall radius of the wire and no point where adjacent curves or lines intersect at an angle.

Example 1

Sharp Angles Cause Greater Attenuation of High Frequency Signals

A pair of conductor cables were prepared having the same diameter and the same length (4 meters). However, a first cable had a cross-sectional shape that was round (consistent with FIG. 1) and the second cable had a cross-sectional shape that was "serrated" having a series of about eight (8) convex portions that met at a sharp angle (consistent with FIG. 4). The attenuation losses in both of these cables were measured at signal frequencies ranging from 10 MHz to 10 GHz.

Figure 16:
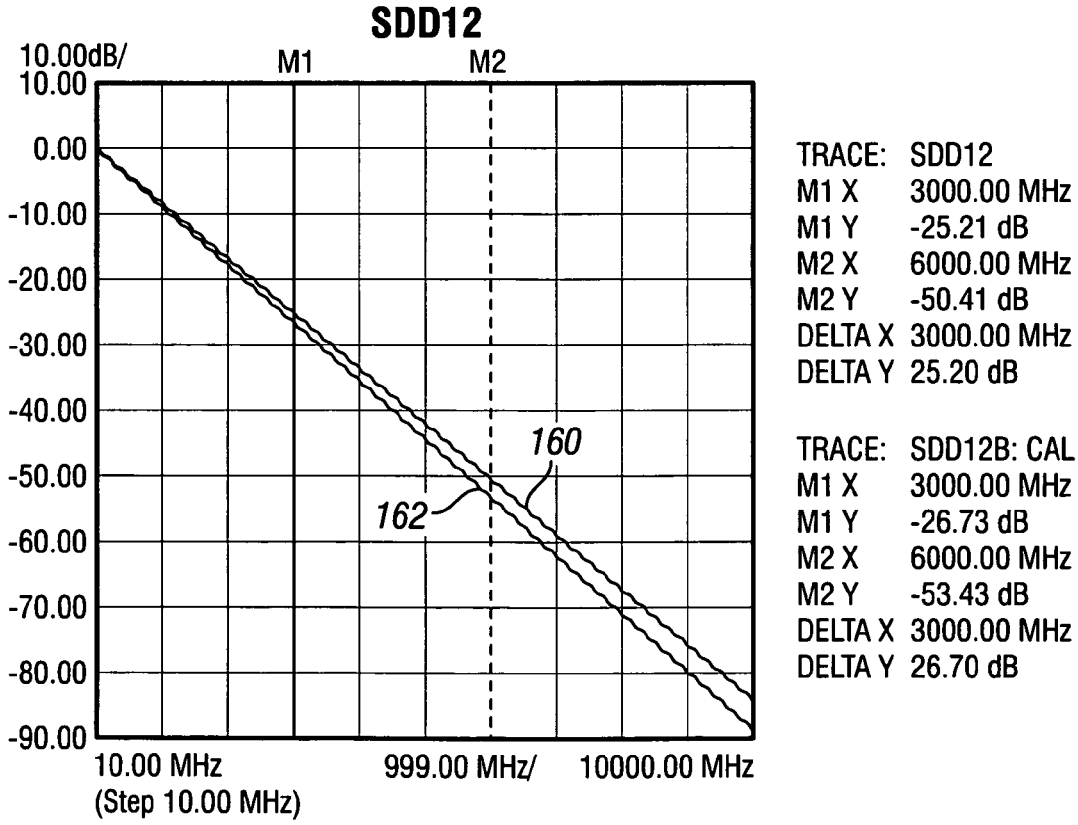
FIG. 16 is a graph of attenuation loss (dB) as a function of signal frequency (MHz) for a round cable according to FIG. 1 and a cable having sharp angles according to FIG. 4.

FIG. 16 is a graph of the attenuation losses (dB) of the two cables that were measured as a function of signal frequency (MHz). The attenuation loss for the round cable is shown by line 160 and the attenuation loss for the serrated cable is shown by line 162. These two lines show that the round cable performed better by about 2 to 3 dB than the serrated cable at 3 GHz and 6 GHz. In general the difference in attenuation was shown to increase with increasing signal frequency. These results are surprising because conventional knowledge of the skin effect has led others to increase the surface area of a cable without regard to the nature of the surface area. However, the graph shows that the benefits of increasing cable surface area are offset, and in this instance more than offset, by the presence of sharp angles that cause current crowding, leading to even greater attenuation losses.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cable, comprising:

an electronically conducting wire with a cross-sectional shape defined by a simple closed curve having from 3 to 8 concave portions separated by an equal number of convex portions, wherein the simple closed curve has no point where the radius of curvature is less than one-sixth (⅙) of an overall radius of the wire and no point where adjacent curves or lines intersect at an angle.

2. The cable of claim 1, wherein the wire has a central axis and an overall radius defined by the most-distal points of the convex portions, wherein the most-proximal points of the concave portions have a distance from the central axis ranging from 15 to 66 percent less than the overall radius.

3. The cable of claim 1, wherein the alternating concave and convex portions of the cross-sectional shape have substantially the same curvature.

4. The cable of claim 1, wherein the overall radius of the wire is from 2 to 10 millimeters and the simple closed curve has no point where the radius of curvature is less than 0.5 millimeters.

5. The cable of claim 1, wherein the simple closed curve has no point where the radius of curvature is less than 0.1 millimeter.

6. The cable of claim 1, wherein the electronically conducting wire is made of metal.

7. The cable of claim 6, wherein the metal is selected from copper and copper alloys.

8. The cable of claim 1, further comprising:

an electronically insulating material disposed about the wire.

9. The cable of claim 1, wherein the surface area of the wire has a substantially continuous charge distribution under a high frequency electronic signal.

10. The cable of claim 9, wherein the high frequency electronic signal has a frequency greater than 100 MHz.

11. The cable of claim 9, wherein the surface area of the wire has a substantially uniform charge distribution under a high frequency electronic signal.

12. The cable of claim 11, wherein the high frequency electronic signal has a frequency greater than 100 MHz.

* * * * *